United States Patent [19]

Schacht

[11] 4,415,425

[45] Nov. 15, 1983

[54] CONDUCTOR ROLL CONTOUR

[75] Inventor: Charles A. Schacht, Pittsburgh, Pa.

[73] Assignee: United States Steel Corporation, Pittsburgh, Pa.

[21] Appl. No.: 358,078

[22] Filed: Mar. 15, 1982

[51] Int. Cl.[3] ..... C01B 21/30; C25D 17/00

[52] U.S. Cl. ..... 204/279; 204/206

[58] Field of Search ..... 204/279, 206–211

[56] References Cited

U.S. PATENT DOCUMENTS

| | | | |
|---|---|---|---|
| 3,483,098 | 12/1969 | Kramer | 204/28 |
| 3,483,113 | 12/1969 | Carter | 204/206 |
| 3,634,223 | 1/1972 | Carter | 204/206 |
| 4,304,653 | 12/1981 | Winand | 204/206 |

*Primary Examiner*—Howard S. Williams
*Assistant Examiner*—Ted Williams
*Attorney, Agent, or Firm*—Arthur J. Greif

[57] ABSTRACT

Conductor rolls used for masking one face of a metal strip while electro-treating the other face thereof, comprise an elastomeric-covered cylinder having a metallic contact ring in the center thereof for electrical contact with the strip being treated. To minimize high transfer current densities, the edges of these contact rings have been provided with a cantilevered flange overlying a portion of the elastomer. It has been found, due to differential thermal expansion, at operating temperature, of both the elastomer and the metal contact ring, that the cantilevered flange section of the contact ring is forced up to an excessive extent, resulting in high bending stresses generated in the strip at the region of the contact ring-elastomer interface. By providing a taper on the cantilever flange section to compensate for the difference in thermal expansion, bending stresses in the strip are reduced to insignificant values, thereby eliminating creases and scratches in the strip.

6 Claims, 6 Drawing Figures

CONDUCTOR ROLL CONTOUR

In the electro-treating (i.e. plating, cleaning and pickling) of metal strip (or sheet), various types of conductor rolls have been employed to effect electrical contact between strip and the power source. When it is desirable to treat only one face of the strip at a time, conductor rolls of the type shown in U.S. Pat. No. 3,634,223, the disclosure of which is incorporated herein by reference, have been employed. These conductor rolls consist of a mild steel body or core having a contact ring, lapped over the central portion of the core, for contact with the metal strip. Elastomeric sealing bands cover the rest of the core, so that during plating, when the metal strip is wrapped around the conductor roll, the edges of the strip contact the sealing bands and prevent the electrolyte from contacting the interwrapped face of the strip. The invention disclosed in the '223 patent is primarily directed to a contact ring in which the edges have an integral tapered flange portion, cantilevered so as to overlie the elastomeric sealing bands and thereby improve (a) the uniformity of the transfer current density between the contact ring and the strip, and (b) the thermally induced seal (at operating temperatures) between the edge of the contact ring and the edge of the juxtaposed sealing band—thereby preventing the entrance of foreign materials at the interface thereof. In utilizing the conductor roll of the type shown in the '223 patent, undesirable creases were noted in the metal strip being plated. It was determined that such creases were caused by excessive differential thermal expansion, at operating temperature, at the interface of the contact ring and the elastomer cover on the roll. As a result of such differential expansion, the uneven roll surface that develops causes excessive tensile stress and localized plastic deformation in the strip wrapped around the roll. A roll contour was developed, which when ground into the roll at room temperature, compensates for the differences in thermal expansion (at the higher operating temperatures of the electro-treating bath) and thereby greatly reduces the stresses in the strip being treated.

Figure 1:
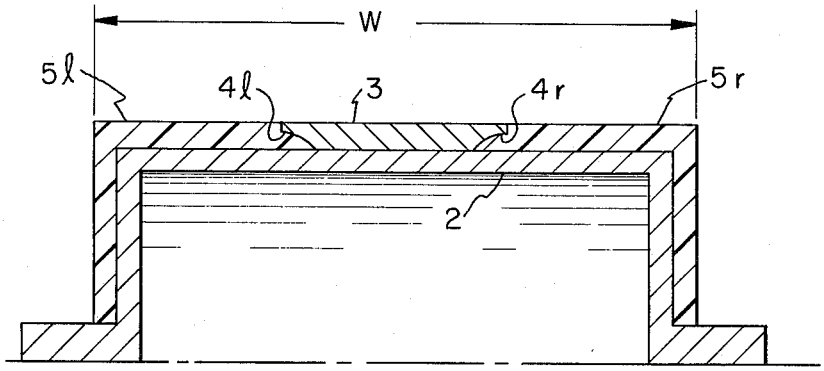
PRIOR ART FIGURE 1
Figure 2:
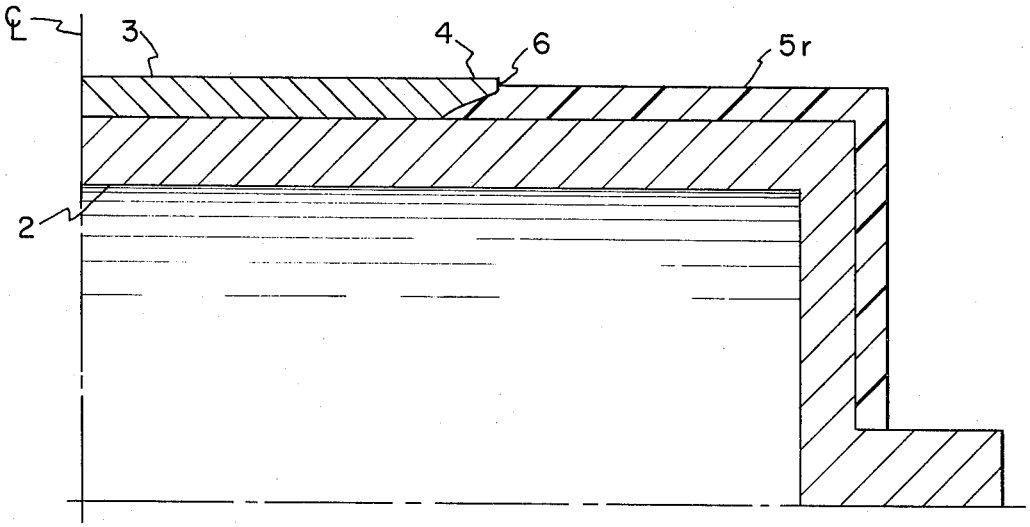
Figure 3:
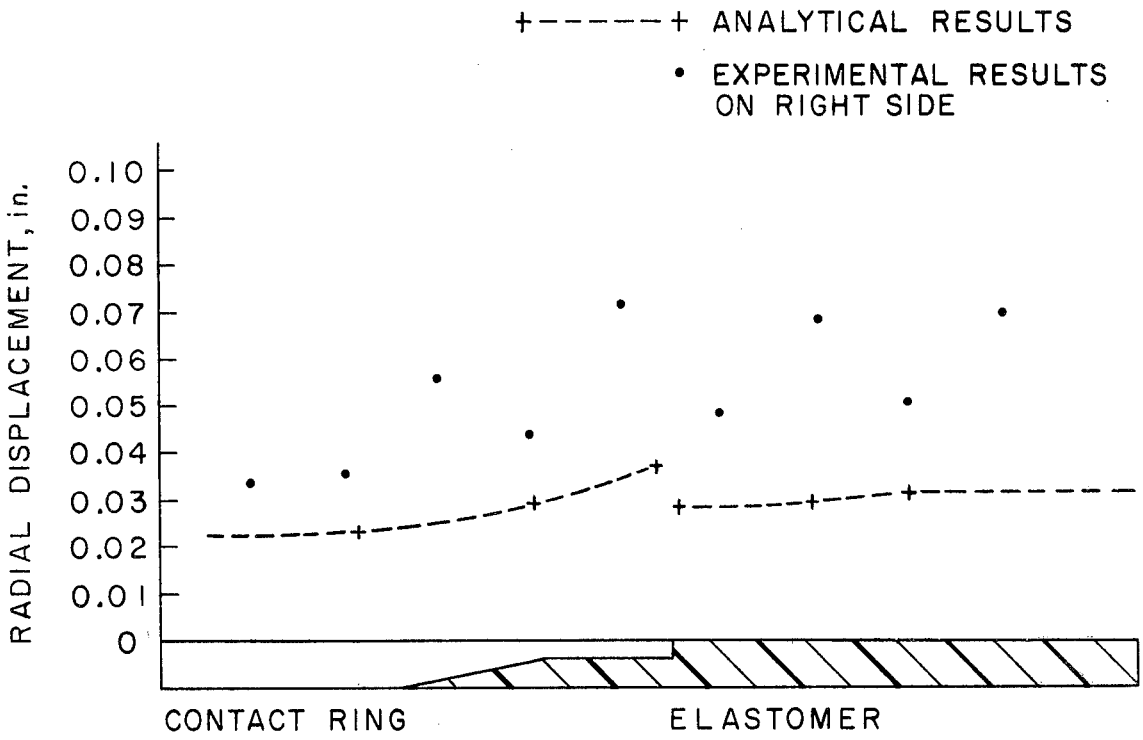
Figure 4:
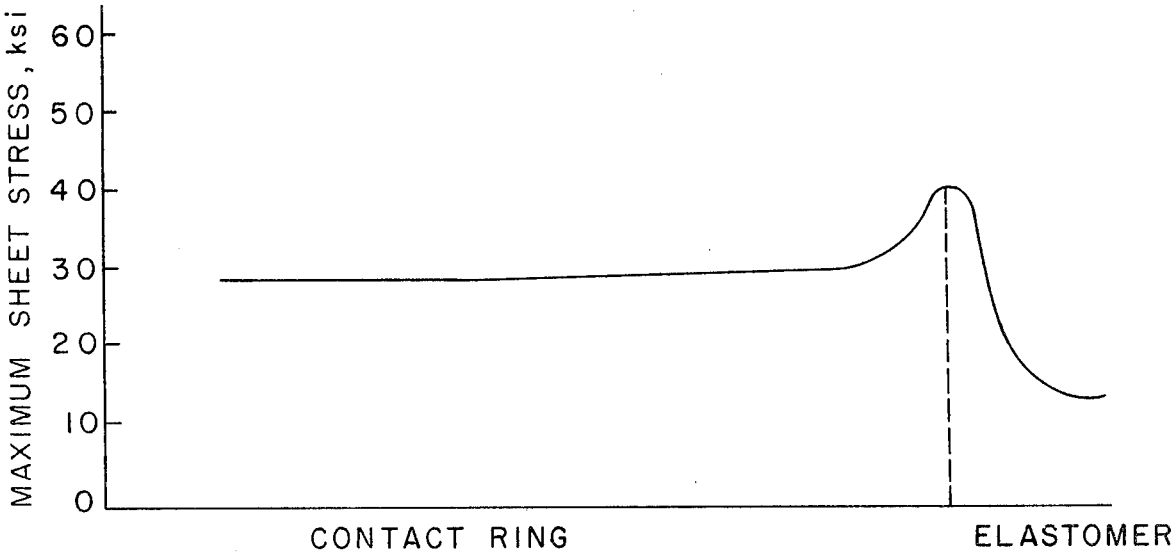
Figure 5:
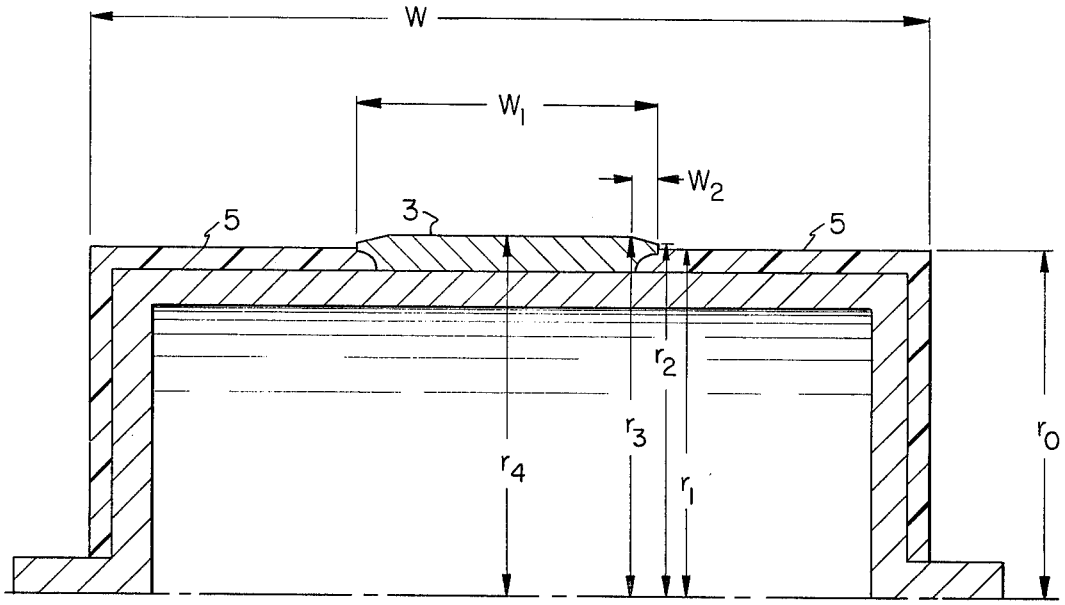
Figure 6:
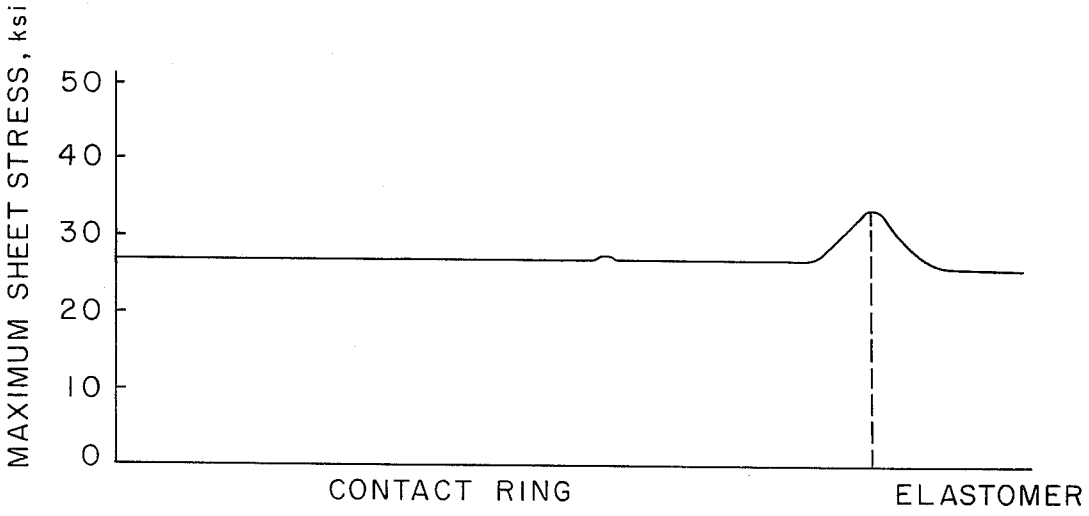

The benefits of the improved roll contour will become more apparent from a reading of the following description when taken into conjunction with the appended claims and the drawings in which:

FIG. 1 is a representational drawing of the salient features of a prior art conductor roll, FIG. 2 shows a first-stage design attempting to overcome the differential expansion of the conductor roll surface materials, FIG. 3 shows the radial displacement of the roll surface, determined both by analytical methods and by actual experimentation, utilizing the roll contour of FIG. 2, FIG. 4 shows the circumferential stress resulting in steel sheet during operating conditions with a wrap tension in the sheet of 27 ksi and using the roll surface contour of FIG. 2, FIG. 5 is a representation of a roll contour at "room" temperature, designed in accord with the instant invention, and FIG. 6 shows the circumferential stress in steel sheet at an operating temperature of 130° F., resulting from the roll contour of FIG. 5.

Referring to FIG. 1, which shows a sectioned top-half of the prior art conductor roll, it may be seen that the roll comprises a cylindrical core 2 with closed ends which accomodate bearings (not shown). In operation, cooling water flows into the bearing on one end and exits at the same end. Exposed midway along the altitude w of the cylindrical core is contact ring 3, constructed from a metal, e.g. stainless steels resistant to the electrolyte in which it is to be used. Both edges of the ring have integral, tapered flange portions, **4*l* and 4*r*, which overlie elastomeric sealing bands 5*l* and 5*r* which cover the remainder of the core. During plating, undesirable creases, i.e. continuous depressions running along the length of the strip were observed, oriented in the longitudinal direction of the strip and located at the contact ring/elastomer interface of the conductor roll. It was opined that these creases resulted from the lack of a flush surface at the elastomer/contact ring interface, resulting from the differences in thermal expansion, at operating temperatures varying from 100° to 180° F., of the stainless steel contact ring and the elastomer, typically hypalon or urethane. To compensate for such thermal expansion, a roll having the contour shown in FIG. 2 was constructed, providing for an offset at 6** (between about 0.01 to 0.03 inches at room temperature, depending upon materials employed) at the contact ring/elastomer interface to compensate for the differing thermal expansion of the two materials. In utilizing such an offset in actual practice, the undesirable creasing, although somewhat lessened, was nevertheless present to an undesirable extent.

Field tests were therefore performed on a similar, newly covered conductor roll. The roll was supported on end bearings and water at 160° F. was circulated through the roll. Dial gauges were placed at various distances from the contact ring/elastomer interface to measure radial displacement of the surfaces. Test conditions differed from actual operating conditions in two principle respects: (i) the roll was free to thermally expand to a greater extent since no metal sheet was stretched around the portion of the roll as it would be during electro-treating conditions, and (ii) the test thermal gradients through the conductor roll walls were opposite from actual operating thermal gradients. Thus, the highest temperature (160° F.) was on the inside wall surface, and the lowest temperatures on the outside of the roll. Analysis of the test included a steady-state thermal analysis to more accurately predict the thermal gradients resulting in radial displacements. These analytical thermal gradients were then used to determine the resultant analytical radial thermal displacements of the conductor roll surface. The analytical displacements in the interface region were then compared to the radial displacements measured during the test. A comparison of the analytical and test results for the interface at the right side of the roll is provided in FIG. 3, which compares the free radial expansion of the metal contact ring and the elastomer surfaces in the region of the interface. As seen in this Figure, the analysis predicted less total radial displacement than the actual test results. Both results, however, show that the cantilevered flange portion of the contact ring will lift because of confined expansion of the elastomer between the mild steel core and the contact ring.

The analytical investigation also included evaluation of the stresses and deflection in a sheet undergoing plating, specifically in the region of the contact ring/elastomer interface. For this analysis, the inside surface of the roll was assumed to be 70° F. The outside surface temperature was assumed to be 130° F. The sheet was assumed to be stretched on the conductor roll so that the tension stress therein was 27 ksi (1,000 lbs per square inch). The resulting calculated stresses in the sheet during the operating conditions is shown in FIG. 4, for a preload tensile strength in the sheet of 27 ksi and an initial offset of 0.021 inches (using the roll surface contour of FIG. 2) at a room temperature of 70° F.

As seen from FIG. 4, the maximum circumferential stress is a tensile stretching caused by the sheet wrapping around the end of the raised cantilever section of the contact ring. This raised section causes additional stretching of the sheet in the circumferential direction and adds to the existing circumferential tensile preload stress in the sheet. The maximum calculated elastic circumferential stress, including the preload tensile stress, is about 40 ksi. This value does not include the bending stress caused by the sheet wrapping around the cylindrical surface of the conductor roll, which would further add to the stress on the outside surface of the sheet. Thus, yielding of the sheet would be expected to occur in this region during normal operating conditions. This yielding and the concomitant local rotation of the sheet can cause a permanent sheet crease.

An improved geometry was therefore designed, FIG. 5, for the interface region and additional analyses were made using this geometry comprising a reduced offset and a slight taper in the upper-surface of the cantilevered flange section. The resultant sheet stresses, using this improved geometry for a preload tension of 27 ksi, is shown in FIG. 6. As seen therein, two significant improvements result: (i) the localized stress increase at the interface is reduced to a nominal value of about 5 ksi, and (ii) the tensile stress in both the contact ring and elastomer regions is made nearly the same. The first effect results from the taper ($r_3$-$r_2$, in FIG. 5) in the flange section of the contact ring, and the latter effect results from a reduced offset (0.01 inch vs. 0.02 inches) permitted by the use of such taper.

The basic features of the new roll contour are shown in FIG. 5. The width, w, of the roll will obviously be sufficient to accommodate the various widths of the metal sheet and strip being electro-treated. The contact ring 3 will have a width $w_1$ somewhat less (generally about 4 inches) than that of the narrowest width of the strip to be treated, so that the edges of the metal strip will form a seal with elastomeric sealing member 5. For most commercial practices, $w_1$ will vary from about 25 to about 50 inches. The length of the flange portion $w_2$ may vary, e.g. as a function of the width of the contact ring, whereby $w_2$ will normally be within the range (0.05 to 0.20) $w_1$, preferably (0.07 to 0.12) $w_1$. The degree of offset, $r_2$-$r_1$, and the degree of taper, $r_3$-$r_2$, (exaggerated in FIG. 5, for purposes of clarity) in the flange section will vary with the degree of differential of thermal expansion encountered, and will be a function of (i) the coefficients of expansion of both the elastomer material and the metal used for the contact ring, (ii) the ambient or room temperature at which the roll is ground to the desired contour, (iii) the operating temperature of the electro-treating solution, and (iv) the thickness of the elastomer. Thus, for one specific example, utilizing an 80-inch wide conductor roll for the electrogalvanizing of steel strip, the width, $w_1$ of the contact member, was 32 inches and each flange had a length $w_2$ of 3.1 inches. For a contact member constructed of austenetic stainless steel and a urethane elastomer, rolls were ground at two different room temperatures. For the roll ground at 60° F., the degree of offset, $r_2$-$r_1$, was 0.026 inches; while for the roll ground at 80° F., an offset of 0.019 inches was employed—both such rolls being designed for an operating temperature of 130° F. and having a taper, $r_3$-$r_2$, of 0.01 inch. Obviously, the degree of offset required would be greater, for example, for elastomers having a greater coefficient of thermal expansion or for higher operating temperatures; but $r_2$ will always be greater than $r_1$ at the ambient temperature at which the contour is ground, and will be sufficient to compensate for the differential expansion of the elastomer vis-a-vis the metal. Similarly, the degree of taper at room temperature should be sufficient so that, (a) the displacement of the flange, caused by the expansion of the elastomer at operating temperature (i.e. 100° to 180° F.) and (b) the resultant expansion of the elastomer, itself, results in $r_3 \approx r_2 \approx r_1$ at the designed operating temperature. These tapers will generally vary, such that $r_3$-$r_2$ will be within the range 0.005 to 0.02 inches, and generally in proportion to $w_2$. To achieve improved tracking of the metal strip during electro-treating, it is also desirable that the roll be provided with a crown such that the outer circumferential radius decreases as it progresses along the roll altitude from $r_4$ to $r_0$.

I claim:

1. In a cylindrically-shaped conductor roll for the electro-treating of one face of metal strip while masking the other face thereof from the electro-treating solution, said roll comprised of:

(i) a generally cylindrical core, the outer circumferential surface of which is encircled by, (ii) a contact member in the form of (a) a metallic ring disposed approximately midway along the wdith of said cylindrical core and (b) metallic angular flange portions integrally joined to said ring along both edges thereof, said flange portions overlying a portion of (iii) elastomeric sealing members encircling the remaining portion of the outer circumferential surface of the core, wherein the radii of the outer circumferential surfaces of said roll, at different points along the width thereof, are defined as:

$r_0$ . . . the radius at the edge $r_1$ . . . the radius of the sealing member at a line substantially perpendicular to the roll outer circumferential surface adjacent the flange portion edge furthermost from the mid-width of the ring, $r_2$ . . . the radius of the flange portion at said adjacency line, $r_3$ . . . the radius where the flange portion is integrally joined to said contact ring, and $r_4$ . . . the radius at the mid-width of the ring, the improvement wherein undesirable creases in the metal strip being treated are eliminated by utilizing an offset such that $r_2 \geqq r_1$ at the ambient temperature under which such contour is provided to the roll, said ambient temperature being substantially below the 100° to 180° F. operating temperature range under which electro-treating will be accomplished, such offset being sufficient to compensate for the greater differential expansion of the elastomer over that occurring in said metal contact ring at said operating temperature, and said flange portion being provided with a taper, $r_3 > r_2$ at said ambient temperature, sufficient to compensate for the displacement of the flange caused by the expansion of the elastomer at said operating temperature, whereby $r_3 \approx r_2 \approx r_1$ when the roll surface reaches a steady-state condition within said operating temperature range.

2. The roll of claim 1, wherein the widths along the outer surface of said roll are defined as:

$w_1$ . . . the width of said contact ring, $w_2$ . . . the width of each of said flange portions, and $w_2 = (0.05 \text{ to } 0.20)\ w_1$.

3. The roll of claim 2, wherein $w_2 = (0.07 \text{ to } 0.12)\ w_1$.

4. The roll of claim 2, wherein $r_2 - r_1$ is within the range 0.01 to 0.03 inches at said ambient temperature.

5. The roll of claim 2, wherein $r_3 - r_2$ is within the range 0.005 to 0.02 inches at said ambient temperature.

6. The roll of claim 4 or 5, in which said ambient temperature is in the range of 60°–80° F.

* * * * *